United States Patent [19]

Woode

[11] Patent Number: 4,660,726

[45] Date of Patent: Apr. 28, 1987

[54] BAR SCREEN

[76] Inventor: Rudolf Woode, Tennisgrand 8, S-170 10 Ekero, Sweden

[21] Appl. No.: 618,637

[22] Filed: Jun. 8, 1984

[30] Foreign Application Priority Data

Jun. 15, 1983 [SE] Sweden ..... 8303411

[51] Int. Cl.[4] ..... B07B 1/16

[52] U.S. Cl. ..... 209/674; 209/396; 209/660; 209/701

[58] Field of Search ..... 209/659, 660, 674, 393–396, 209/701; 130/26

[56] References Cited

U.S. PATENT DOCUMENTS

| | | | |
|---|---|---|---|
| 368,915 | 8/1887 | Foran | 209/396 X |
| 810,922 | 1/1906 | Dickey | 130/26 X |
| 1,117,876 | 11/1914 | Mason | 209/396 |
| 1,552,397 | 9/1925 | Edwards | 209/396 X |
| 1,608,640 | 11/1926 | Wilson | 209/396 |
| 1,860,480 | 5/1932 | Royer | 209/396 |
| 2,446,646 | 8/1948 | Forrest | 209/396 X |
| 3,064,812 | 11/1962 | Wehner | 209/396 |
| 3,811,568 | 5/1974 | Pearson | 209/674 |
| 3,971,716 | 7/1976 | Foreman | 130/26 X |
| 4,240,588 | 12/1980 | Fulghum, Jr. | 209/674 X |
| 4,504,386 | 3/1985 | Dyrén et al. | 209/674 X |

*Primary Examiner*—Robert B. Reeves
*Assistant Examiner*—Edward M. Wacyra
*Attorney, Agent, or Firm*—Dirk J. Veneman; Raymond W. Campbell

[57] ABSTRACT

A bar screen for the separation by size of lump goods, such as wood chips, according to its thickness, and comprising parallel bars (1–5) provided with flights (6), where the bars are mutually movable.

7 Claims, 6 Drawing Figures

Fig. 3.
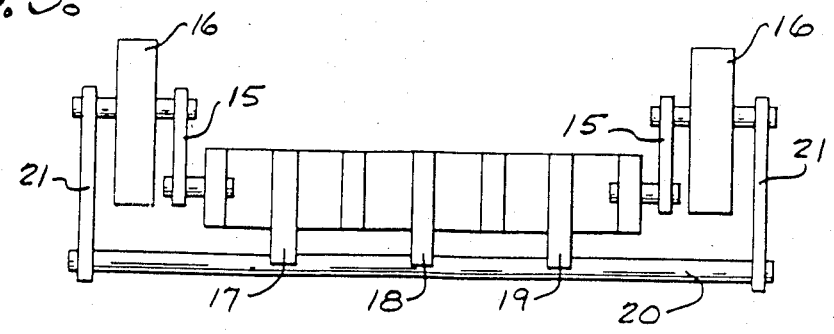
Fig. 4.
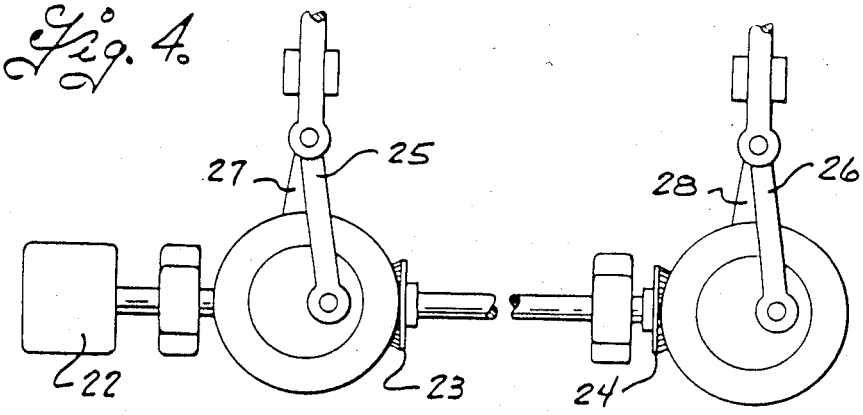
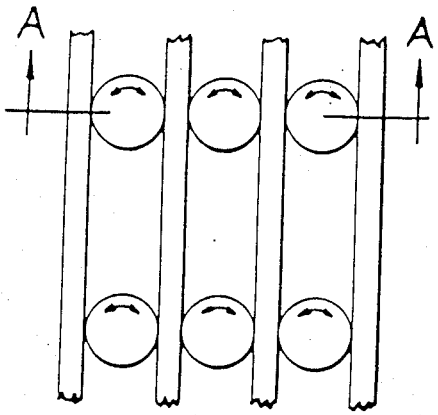
Fig. 5.
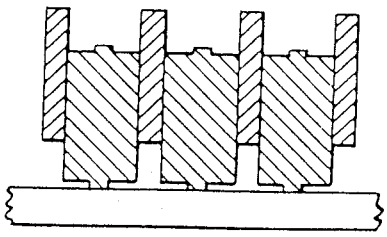
Fig. 6.

BAR SCREEN

DESCRIPTION

The invention relates to a bar screen for use in separating oversize particles from a mixture, e.g. separating thick pieces of wood chips from a mixture of wood chips.

In the cellulose industry, nearly all chip screening is done on conventional holed screens which separate the chips according to their length and breadth. It is known, however, that if chips that are too thick are used in the production of sulphate pulp, the pulp yield will be lower and the shives content higher. A new type of screen has therefore begun to be installed in sulphate mills, a so-called disk screen, which screens the chips according to their most important dimension, —their thickness. See for example "Svensk Papperstidning" 65 (22): 905. This screen comprises disks mounted on rotating shafts and has a constant distance between the disks. See for example "Svensk Papperstidning" 82 (18): 534.

The disadvantage with this screen, primarily due to its low capacity per square meter of screening surface, is that it becomes large, and thus expensive, costing about five times more than a conventional screen. The low capacity is partly due to the open area of the screen being relatively small and partly due to many chips travelling a considerable distance over the screen before they are accepted by it, thus partially blocking the open area, with resulting reduced capacity. Another disadvantage of the disk screen is that it is more demanding in energy than conventional holed screens. A disk screen operated such that the chips are lifted or thrown up before they are accepted or rejected, and this lifting work results in high energy consumption.

The invention relates to a screen with a high capacity per square meter of screening surface and with low energy consumption.

FIG. 3 is a cross-sectional view taken on line A—A of FIG. 2.

FIG. 4 is a plan view of a suitable drive mechanism for the bar screen.

FIG. 5 is a plan view of a modified form of the invention shown in the preceding drawings.

FIG. 6 is a cross-sectional view of the modified embodiment shown in FIG. 5, taken along line A—A of FIG. 5.

Figure 1:
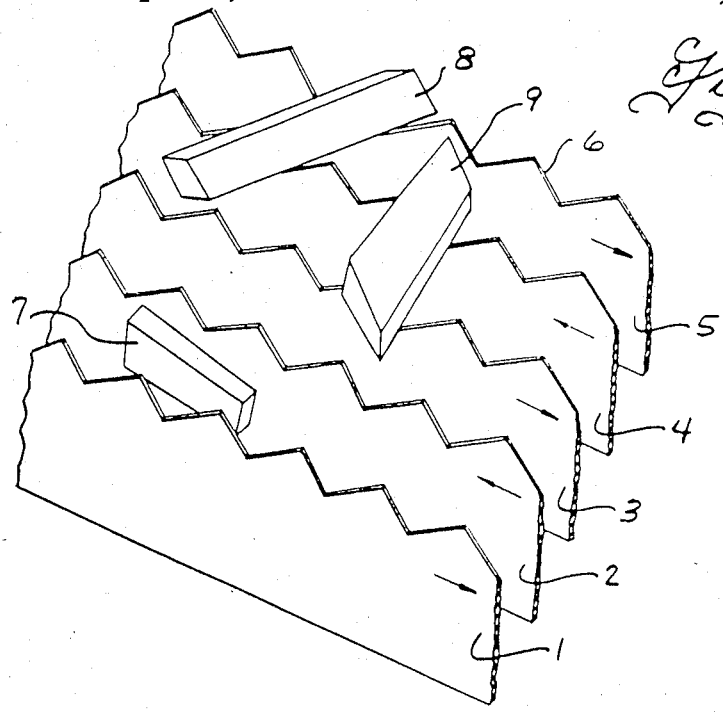
FIG. 1 is a perspective view of a bar screen embodying the present invention.

FIG. 1 is a perspective view of the inventive bar screen, which has parallel and sloping bars. The screening plane may slope in the direction of the bars or at right angles to them. On one side the bars 1, 3, 5 and on the other side bars 2, 4 are mutually movable. The upper side of the bars is not smooth, but has projecting portions 6, e.g. triangular flights. Chips that are fed out onto a screen fall higgledy-piggledy, as is illustrated by the different positions in FIG. 1. Only a few chips fall down directly through the gaps between the bars. In most cases (8, 9) they fall across the bars, and would block them if they were not quickly reoriented in the direction of the gaps. This is accomplished in the inventive screen by the flights 6 engaging with the chips and turning them in the direction of the gaps when the bars move. Narrow chips are thus rapidly accepted, while chips thicker than the gap are conveyed away over the sloping screen surface by the action of gravity.

Figure 2:
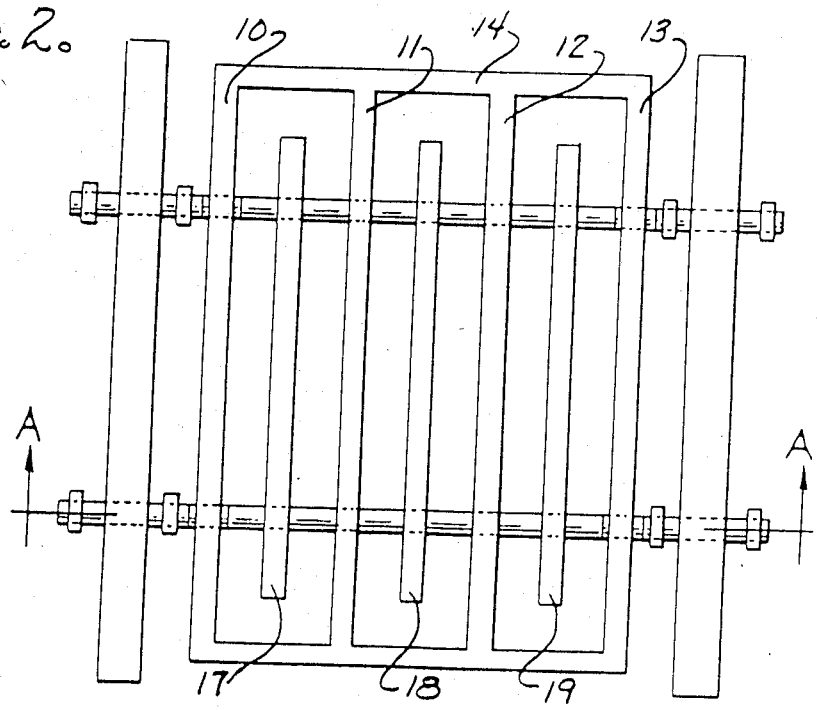
FIG. 2 is a plan view of the bar screen.

FIG. 2 illustrates the inventive screen in a plan view showing the screening surface, and FIG. 3 is a section along the line A—A in FIG. 2. The bars 10, 11, 12, 13 are kept together by the end walls 14 and are suspended by links 15 mounted in screen frame side members 16. The bars 17, 18, 19 are kept together by cross beams 20, suspended by links 21 mounted in members 16. The screen thus comprises two bar arrays suspended in oscillatable links. The bar arrays are given an oscillating motion such that they move in mutually opposite directions. FIG. 4 illustrates in a plan view an embodiment of an apparatus that can be used to provide the desired oscillating movement, which is predetermined in magnitude. A motor 22 drives a shaft on which are mounted two conical gears 23, 24. On each of the two output shafts, one to each gear, there are mounted two eccentrics, each of which imparts a reciprocating motion to rods connected to the bar arrays. The connecting rods 25, 26 and 27, 28 coact to give each bar array an oscillating motion in counter direction to the other and of a predetermined magnitude. Since each bar array is actuated by two rods, a stable reciprocating motion is obtained. If the bar arrays are given the same mass and the eccentrics have a mutual angular shift of 180 degrees, the acceleration and retardation forces will cancel each other. The frame side members will therefore not need to take up any notable forces, enabling the screen to be suspended in cables mounted on the side members, for example.

The screen may also be implemented such that one bar array is fixed while the other is movable. A drawback here is that the side members are subject to a larger periodical force. One way of avoiding this is to subdivide the movable array into two or more minor arrays having opposing oscillating motion.

In the inventive screen, blockage of the gaps is avoided by the bars describing an oscillating motion. A very old way of avoiding blocking the screening apertures in a screen is to allow the screen to vibrate. The vertical component of the oscillating motion gives the same effect, but there is an additional effect from the movement of the bars in the screening plane, which assists in loosening chips that have fastened.

To still further eliminate the risk of blockage it has been found advantageous to make the gaps with "relief," i.e. they diverge in the accept direction.

For a bar screen to have good efficiency, i.e. to separate over thick chips as completely as possible, it is required that the gaps have the same size over the entire screen. This can be achieved by the bars being given greater rigidity, e.g. by the selection of a suitable profile such as a T section. Another method is to provide the gaps with spacers keeping the bars at mutual, given spacing.

However, the spacers cause friction and get rapidly worn. FIGS. 5 and 6 illustrate a novel method where rollers are placed between, and engage against, pairs of bars. When the bars move, the rollers will make a reversing rotational movement. If the screen has fixed bars, the rollers can be mounted on either the fixed or the moving bars. Another method is to mount the rollers on fixed bars, so that they bear against a moving bar on either side of the fixed bar.

I claim:

1. A bar screen for separation by size of lump goods such as chips according to thickness, comprising parallel bars implemented such that adjacent bars are movable relative to each other, said bars being spaced from each other to permit the passage therebetween of goods of acceptable thickness while restricting the passage therebetween of over-thick goods and goods improperly oriented for sizing the thickness thereof, flights disposed on the upper edges of at least one-third of the bars for engaging over-thick goods and goods improperly oriented for separation, and drive means connected to first and second sets of said bars for effecting oscillating linear motion of said sets of bars such that said sets move in opposite directions in the plane of the screening surface, and said bars and flights engage against the goods for turning the goods when the bars are in motion to properly orient the goods for sizing the thickness dimension thereof.

2. Screen as claimed in claim 1, characterized in that a fixed bar is adjacent a moving bar.

3. A screen as claimed in claim 2 characterized in that between two fixed bars there are two bars moving in opposite directions.

4. A screen as claimed in claims 1, 2 or 3 characterized in that the movable bars are made into bar arrays which are suspended in oscillatable links.

5. A screen as claimed in claims 1, 2 or 3 characterized in that reversibly rotatable bodies are placed between, and bear against the bars.

6. A screen as claimed in claim 5, characterized in that said bodies are mounted on one of the bars.

7. A screen as claimed in claims 1, 2 or 3 characterized in that the bar sets are put in motion by a synchronized eccentric transmission.

* * * * *